United States Patent [19]

Wohrle, deceased

[11] Patent Number: 4,836,133

[45] Date of Patent: Jun. 6, 1989

[54] COATING DEVICE

[75] Inventor: Albert Wohrle, deceased, Heidenheim, Fed. Rep. of Germany, by Ingrid Wohrle, executor

[73] Assignee: J. M. Voith GmbH, Heidenheim, Fed. Rep. of Germany

[21] Appl. No.: 843,141

[22] Filed: Mar. 24, 1986

[30] Foreign Application Priority Data

Apr. 17, 1985 [DE] Fed. Rep. of Germany ..... 3513790

[51] Int. Cl.[4] ..... B05C 5/02

[52] U.S. Cl. ..... 118/410; 118/413

[58] Field of Search ..... 118/410, 413

[56] References Cited

U.S. PATENT DOCUMENTS

| | | | |
|---|---|---|---|
| 4,250,211 | 2/1981 | Damrau et al. | 118/411 X |
| 4,327,662 | 5/1982 | Damrau | 118/410 |
| 4,357,370 | 11/1982 | Alheid | 427/211 |
| 4,398,494 | 8/1983 | Alheld | 118/410 |
| 4,405,661 | 9/1983 | Alheid | 427/356 |
| 4,495,888 | 1/1985 | Wohrle et al. | 118/410 |
| 4,503,804 | 3/1985 | Damrau | 118/410 |

*Primary Examiner*—Shrive Beck
*Assistant Examiner*—Alain Bashore
*Attorney, Agent, or Firm*—Albert L. Jeffers; Richard L. Robinson Jeffers, Hoffman & Niewyk

[57] ABSTRACT

A coating deckle of a coating device including a holder for a soft rubber sealing element wherein the holder includes a sealing tongue aligned parallel to the restrictor plate which extends parallel to the opposite roll supporting the web in the area of the coating device. The sealing tongue bears flat on the restrictor plate and seals in the area of the restrictor plate and the application space which is formed between the restrictor plate of the web or opposite roll and the blade element.

8 Claims, 1 Drawing Sheet

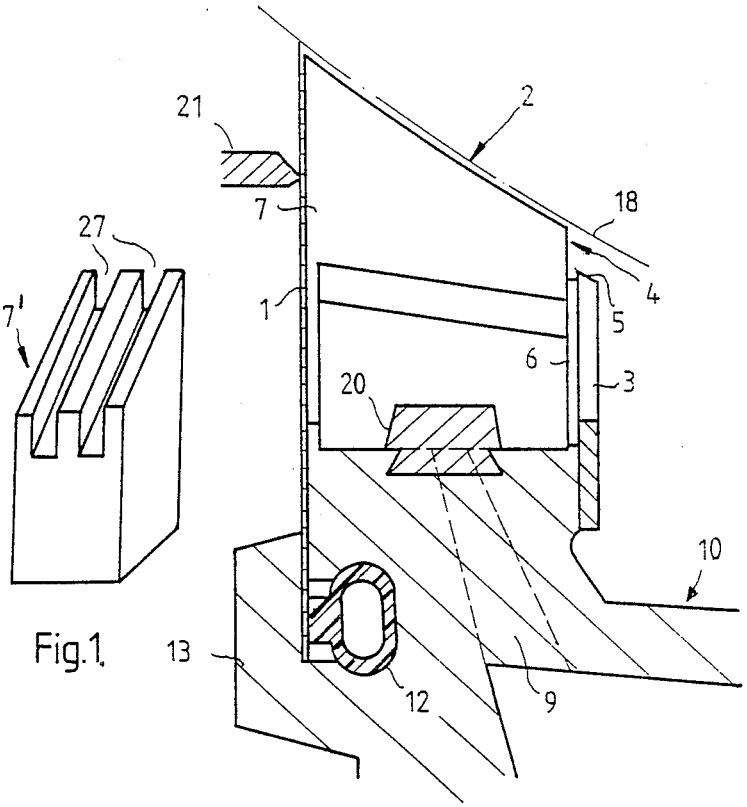
Fig. 3
Fig. 1
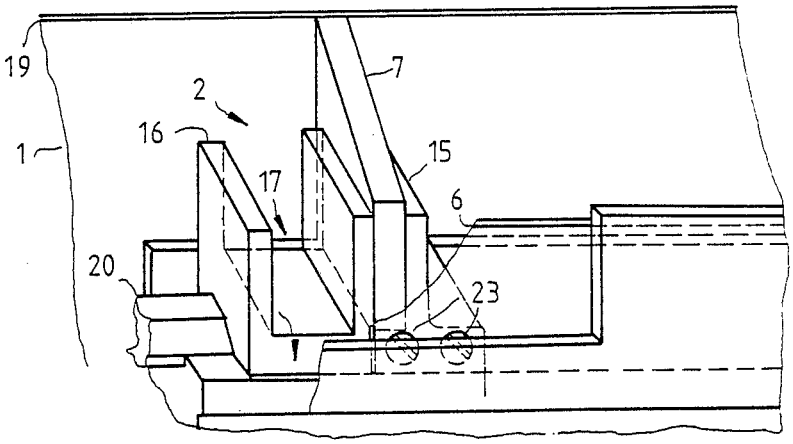
Fig. 2

COATING DEVICE

BACKGROUND OF THE INVENTION

The invention is directed to a coating device, and more particularly, to a coating device for a web passing over a rotatable roll and extending essentially across the width of a coating mixture application space defined at its trailing end by a blade element provided with a coating face for smoothing the coating mixture remaining on the web, and at its leading end by a restrictor plate extending parallel to the coating face blade element, and at its sides by a coating deckle. A coating device for a web is shown in issued U.S. Pat. No. 4,398,494.

In the case of the device shown in U.S. Pat. No. 4,398,494, the sealing element supported by the coating deckle is shown as being a multi-part construction made from various plastic materials in a relatively complex fashion. The surface of the sealing element may be provided with several grooves for forming a labyrinth seal. In its upper area, the sealing element seals directly against the restrictor plate located on the oncoming end of the web, and it is thereby not possible to collect, in a suitable fashion, the coating substance which issues out of the application space through the sealing gap of the sealing element so as to pass it into a pickup container without causing considerable contamination.

SUMMARY OF THE INVENTION

In contrast, the problem which underlies the present invention is to provide for a coating deckle of such a design that a flawless seal is achieved through the sealing element relative to the web and doctor blade, and further, that sealing is achieved relative to the restrictor plate. Finally, another problem underlying the invention is to provide for the flawless removal of the coating substance which issues out of the application space through the sealing element.

In a coating device for a web passing over a rotatable roll, the above problems are solved by providing a coating deckle having a sealing element, and holder means for holding the sealing element towards the rotatable roll, a holding space adapted to receive excess coating mixture that issues out of the application space by way of the sealing element, and a sealing tongue fixed to the coating deckle and extending parallel to the restrictor plate for a distance at least corresponding to the adjustment distance of the coating deckle wherein said sealing tongue bears flat on the restrictor plate. When constructing the sealing element from soft rubber that is plate shaped, another advantage which is achieved is that such a sealing element is a relatively simple component that may be easily stocked. This is important because these sealing elements must be available in various shapes because of the fact that tilting the coating device is supposed to change the angle of the doctor blade, i.e. the angle at which the doctor blade contacts the web, which also changes the sealing angle in the gusset area between the web and the doctor blade.

The above-mentioned and other features and objects of this invention and the manner of attaining them will become more apparent and the invention itself will be best understood by reference to the following description of an embodiment of the invention taken in conjunction with the accompanying drawings.

BRIEF DESCRIPTION OF THE DRAWINGS

FIG. 1 shows a cross section of the coating device in the area near the web;

FIG. 2 is a perspective view of the coating deckle; and

FIG. 3 is a perspective view of a variant of the coating element.

DETAILED DESCRIPTION OF SPECIFIC EMBODIMENTS

Referring to the drawings, the doctor blade 1 serves in the specific embodiments as a preferred blade element and is held in a groove in which it is forced by a pneumatic pressure hose 12 on the front wall 13 of the coating device. The coating deckle is generally designated as 2, and is located, as viewed transversely to the web, between the doctor blade 1 and a restrictor plate 3. Restrictor plate 3 is, relative to the web, located on the leading side of the application space 4 for the coating substance. Restrictor plate 3 has a top edge 5 which is spaced from web 18 so that a restricting gap 8 is created therebetween through which excess coating substance can issue out of the application space 4.

The coating substance is fed into the application space 4 through a slot-shaped channel 9 from the application chamber 10 which holds the coating substance. A sealing tongue 6, which extends parallel to the restrictor plate 3, is fixed to the coating deckle 2 on its leading side. Sealing tongue 6 overlaps the restrictor plate 3 and bears on it in a flat and sealing fashion. For this purpose, it is advantageous to construct the sealing tongue 6 from a resilient material, for example, spring, steel or bronze. Coating deckle 2 includes a holder for sealing element 7, which preferably consists of soft rubber, wherein the holder consists of two guide walls 14 and 15 forming a guideway therebetween. Guide walls 14 and 15 are arranged parallel to each other and accommodate therebetween the plate-shaped sealing element 7. The coating deckle 2 may be produced through injection molding separately or it may be produced so as to include an integral plastic sealing tongue.

The device of the invention offers the advantage that when one adjusts the sealing gap between sealing element 7 and the web or the roll supporting the web, the sealing gap can be initially reduced to zero so as to obtain a starting position so accurate that the sealing gap for the operation can be adjusted very accurately. FIG. 1 presents the sealing gap in an exaggerated fashion.

Due to the softness of the sealing element 7, this adjustment operation does not involve any risk of damaging the opposite roll. Moreover, the sealing component is so soft that upon deformation of the doctor blade such as is possible, for example, due to pressure part 21, the sealing component will give relatively easily and not exert any large resistive force. Of course, the sealing element 7 could also be shaped somewhat differently in that it can be somewhat wider and feature grooves in the form of a labyrinth seal. Further, sealing element 7 could also be made of a soft plastic material, but the seal should by no means be shaped so wide and so complicated as that seal shown in U.S. Pat. No. 4,398,494.

The sealing faces of the plate-shaped sealing element are essentially flat everywhere and have a width equal to the plate thickness which is preferably at least 6 mm. This makes it possible to safely avoid damage to the opposite roll when dragging the sealing element on it during the alignment operation prior to the first use of the sealing element.

Sealing tongue 6 is fastened to the end of the coating deckle 2 by means of two screws 23. Coating deckle 2 features in its outer area a wall 16, parallel to outer guide wall 14, and together with wall 14 form a collecting space 17 for collecting coating substance which issues out of the application space 4 through sealing element 7. Coating substance then drains from collecting space 17, in the direction of the unmarked curved arrow, through the illustrated recess in the restrictor plate 3 and is collected in a pick-up pan (not illustrated).

Coating deckle 2 features a dovetailing which outwardly, that is, from the center of the roll to its end, is fashioned as an adjustment slide 20 by means of which the coating deckle can be moved parallel to the coating edge 19 of the doctor blade 1. This makes it possible to set the deckle format, with the sealing tongue 6 ensuring at any rate that the application space 4 will be sealed along the restrictor blade 3, since the sealing tongue 6 covers the recess in the restrictor plate.

As illustrated in FIG. 3, there is a sealing element 7' which on its surface facing towards the web and which forms the sealing gap as formed therein a plurality of labyrinth grooves 27.

While there have been described above the principles of this invention in connection with specific apparatus, it is to be clearly understood that this description is made only by way of example and not as a limitation to the scope of the invention.

What is claimed is:

1. A coating device for a web passing over a rotatable roll and extending essentially across the width of a coating mixture application space defined at the trailing end by a blade element provided with a coating edge for smoothing the coating mixture remaining on the web and at the leading end by a restrictor plate extending parallel to the coating edge of the blade element and at each side by a respective coating deckle adjustable within a range in a direction parallel to the coating edge of the blade element, the restrictor plate including a pair of recesses, each coating deckle comprising:

a sealing element ;

a holder means for holding the sealing element toward the rotatable roll, a collecting space disposed outwardly of said sealing element and communicating with a respective one of said pair of recesses of the restrictor plate to receive excess coating mixture issued out of the application space by way of the sealing element and direct the excess coating mixture through the respective recess of the restrictor plate, and a sealing tongue fixed to the coating deckle and extending inwardly of said sealing element parallel to the restrictor plate for a distance at least corresponding to the range of adjustment of the coating deckle, said sealing tongue bearing flat on the restrictor plate and covering the respective recess of the restrictor plate inwardly of said sealing element.

2. The coating device of claim 1 wherein said sealing element includes a surface facing the web, and said surface having a plurality of labyrinth grooves therein.

3. The coating device of claim 1 wherein said sealing element is plate-shaped.

4. The coating device of claim 1 wherein said sealing element is made of a resilient material.

5. The coating device of claim 1 wherein said holder means defines in part said collecting space.

6. The coating device of claim 1 wherein said sealing tongue is made of an elastic, resilient material.

7. The coating device of claim 3 wherein said sealing element has a thickness and a flat sealing face, said flat sealing face having a width equal to the thickness of the sealing element.

8. The coating device of claim 7 wherein the width of the sealing face is at least 6 mm.

* * * * *

UNITED STATES PATENT AND TRADEMARK OFFICE

CERTIFICATE OF CORRECTION

PATENT NO. : 4,836,133

DATED : June 6, 1989

INVENTOR(S) : Albert Wohrle

It is certified that error appears in the above-identified patent and that said Letters Patent is hereby corrected as shown below:

Claim 1, Col. 4, line 4, after "element" insert --cooperating with said web to define a sealing gap therebetween;

means for directing and collecting coating mixture issuing from said application space past said sealing gap, which means includes--.

Signed and Sealed this

Thirteenth Day of February, 1990

*Attest:*

JEFFREY M. SAMUELS

*Attesting Officer*

*Acting Commissioner of Patents and Trademarks*